US006287216B1

(12) United States Patent
Boehm

(10) Patent No.: US 6,287,216 B1
(45) Date of Patent: Sep. 11, 2001

(54) WOUND GOLF BALL AND METHOD OF MAKING SAME

(75) Inventor: Herbert C. Boehm, Norwell, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/453,955

(22) Filed: Dec. 3, 1999

(51) Int. Cl.[7] ..... A63B 37/08; A63B 37/06
(52) U.S. Cl. ..... 473/354; 473/357
(58) Field of Search ..... 473/354, 358, 473/356, 357

(56) References Cited

U.S. PATENT DOCUMENTS

| | | | | |
|---|---|---|---|---|
| 707,263 | | 8/1902 | Saunders . | |
| 715,295 | | 12/1902 | Richards . | |
| 736,231 | | 8/1903 | Davis . | |
| 878,070 | | 2/1908 | Kingzett . | |
| 889,709 | | 6/1908 | Mingay . | |
| 1,167,396 | | 1/1916 | Gammeter . | |
| 1,192,831 | * | 7/1916 | Knight | 473/354 |
| 1,194,751 | | 8/1916 | Knight . | |
| 1,366,930 | | 2/1921 | Pearce . | |
| 1,426,712 | | 8/1922 | Chatfield . | |
| 1,524,171 | | 1/1925 | Chatfield . | |
| 1,530,820 | | 3/1925 | Evans et al. . | |
| 1,534,104 | | 4/1925 | Gammeter . | |
| 1,568,514 | | 1/1926 | Lewis . | |
| 1,904,012 | | 4/1933 | Reichard . | |
| 1,907,047 | | 5/1933 | Davis . | |
| 1,945,062 | | 1/1934 | Miller . | |
| 1,981,959 | | 11/1934 | Landreth . | |
| 2,074,808 | | 3/1937 | Rickey . | |
| 2,083,155 | | 6/1937 | Leguillon . | |
| 2,181,350 | * | 11/1939 | Smith | 473/354 |
| 2,225,213 | * | 12/1940 | Gammeter | 473/354 |
| 2,253,331 | | 10/1941 | Miller . | |
| 2,275,658 | | 3/1942 | Slovin . | |
| 2,278,551 | | 4/1942 | Martin . | |
| 2,307,182 | * | 1/1943 | Young | 473/354 |
| 2,324,768 | | 7/1943 | Crawford . | |
| 2,342,603 | * | 2/1944 | Ryan | 473/354 |
| 2,343,160 | | 2/1944 | Smith . | |
| 2,354,017 | | 7/1944 | Hazell . | |
| 2,363,059 | | 11/1944 | Greene et al. . | |
| 2,367,867 | | 1/1945 | Huse . | |
| 2,499,344 | | 2/1950 | Smith . | |
| 2,652,254 | | 9/1953 | Verburg . | |
| 2,939,710 | | 6/1960 | Dosmann et al. . | |
| 2,998,977 | | 9/1961 | Molitor . | |
| 3,031,194 | | 4/1962 | Strayer . | |
| 3,458,206 | | 7/1969 | Kane et al. . | |
| 3,490,770 | | 1/1970 | Satchell et al. . | |
| 3,616,101 | | 10/1971 | Satchell et al. . | |
| 4,244,855 | | 1/1981 | Cox et al. . | |
| 4,442,382 | | 4/1984 | Fleck . | |
| 4,783,078 | | 11/1988 | Brown et al. . | |
| 4,805,914 | | 2/1989 | Toland . | |
| 4,858,923 | | 8/1989 | Gobush et al. . | |
| 4,858,924 | | 8/1989 | Saito et al. . | |
| 4,904,320 | | 2/1990 | Isaac et al. . | |
| 4,938,471 | | 7/1990 | Nomura et al. . | |
| 4,943,332 | | 7/1990 | Sakaguchi et al. . | |
| 5,000,458 | | 3/1991 | Proudfit . | |
| 5,019,319 | | 5/1991 | Nakamura et al. . | |

(List continued on next page.)

*Primary Examiner*—Mark S. Graham
*Assistant Examiner*—Raeann Groden
(74) *Attorney, Agent, or Firm*—Pennie & Edmonds LLP

(57) ABSTRACT

A wound golf ball includes a center, at least one cover layer, and at least one wound layer disposed between the center and the cover layer. The center has a two-layer shell formed of different materials, where one layer is formed of a thermoplastic material and the other layer is formed of a thermoset material. The center is filled with a fluid having a fluid volume of at least 0.5 cubic inches. In one embodiment, the thermoplastic layer is formed of a hydrophobic material so that it has a water vapor permeation rate of less than about 250 (g·mil)/(100 in$^2$·day).

23 Claims, 5 Drawing Sheets

U.S. PATENT DOCUMENTS

| | | |
|---|---|---|
| 5,020,803 | 6/1991 | Gendreau et al. . |
| 5,033,749 | 7/1991 | Kakiuchi et al. . |
| 5,037,104 | 8/1991 | Watanabe et al. . |
| 5,150,906 | 9/1992 | Molitor et al. . |
| 5,194,191 | 3/1993 | Nomura et al. . |
| 5,215,308 | 6/1993 | Hiraoka et al. . |
| 5,273,286 | 12/1993 | Sun . |
| 5,314,187 | 5/1994 | Proudfit . |
| 5,314,555 | 5/1994 | Fukazawa . |
| 5,338,038 | 8/1994 | Cadorniga . |
| 5,340,112 | 8/1994 | Hamada et al. . |
| 5,421,580 | 6/1995 | Sugimoto et al. . |
| 5,467,994 | 11/1995 | Moriyama et al. . |
| 5,480,155 | 1/1996 | Molitor et al. . |
| 5,496,034 | 3/1996 | Maruko et al. . |
| 5,496,035 | 3/1996 | Gilchrist et al. . |
| 5,497,996 | 3/1996 | Cadorniga . |
| 5,511,791 | 4/1996 | Ebisuno et al. . |
| 5,586,950 | 12/1996 | Endo . |
| 5,597,365 | 1/1997 | Yamada et al. . |
| 5,605,512 | 2/1997 | Yamada et al. . |
| 5,609,532 | 3/1997 | Chikaraishi . |
| 5,677,054 | 10/1997 | Kakiuchi . |
| 5,683,311 | 11/1997 | Kakiuchi . |

* cited by examiner

WOUND GOLF BALL AND METHOD OF MAKING SAME

FIELD OF THE INVENTION

This invention relates to golf balls and, more particularly, to wound golf balls with fluid-filled centers.

BACKGROUND OF THE INVENTION

Wound golf balls are the preferred ball of more advanced players due to their spin and feel characteristics. Wound balls typically have either a solid rubber or fluid-filled center around which a wound layer is formed, which results in a wound core. The wound layer is formed of thread that is stretched and wrapped about the center. The wound core is then covered with a durable cover material, such as a SURLYN® or similar material, or a softer "performance" cover, such as Balata or polyurethane. Examples of such balls are disclosed in U.S. Pat. Nos. 4,244,855; 5,020,803; 5,033,749; 5,496,034; and 5,683,311.

Wound balls are generally softer and provide more spin than solid balls, which enables a skilled golfer to have more control over the ball's flight and final position. Particularly, with approach shots into the green, the high spin rate of soft covered, wound balls enables the golfer to stop the ball very near its landing position. In addition, wound balls exhibit lower compression than non-wound balls. Although the higher spin rate exhibited by wound balls means wound balls generally display shorter distance than hard covered non-wound balls, the advantages of wound constructions over non-wound ones are more related to targeting or accuracy than distance.

The United States Golf Association (USGA), the organization that sets the rules of golf in the United States, has instituted a rule that prohibits the competitive use in any USGA sanctioned event of a golf ball that can achieve an initial velocity of 76.2 meters per second (m/s), or 250 ft/s, when struck by a driver with a velocity of 39.6 m/s, i.e., 130 ft/s (referred to hereinafter as "the USGA test"). However, an allowed tolerance of 2 percent permits manufacturers to produce golf balls that achieve an initial velocity of 77.7 m/s (255 ft/s).

Players generally seek a golf ball that delivers maximum distance, which requires a high initial velocity upon impact. Therefore, in an effort to meet the demands of the marketplace, manufacturers strive to produce golf balls with initial velocities in the USGA test that approximate the USGA maximum of 77.7 m/s or 255 ft/s as closely as possible. Manufacturers try to provide these balls with a range of different properties and characteristics, such as spin.

To meet the needs of golfers with various levels of skill, golf ball manufacturers are also concerned with varying the level of the compression of the ball, which is a measurement of the deformation of a golf ball under a fixed load. A ball with a higher compression feels harder than a ball of lower compression. Wound golf balls generally have a lower compression which is preferred by better players. Whether wound or non-wound, all golf balls become more resilient (i.e., have higher initial velocities) as compression increases. Manufacturers of both wound and non-wound construction golf balls must balance the requirement of higher initial velocity from higher compression with the desire for a softer feel from lower compression.

Therefore, golf ball manufacturers are continually searching for new ways in which to provide wound golf balls that deliver good performance for golfers.

SUMMARY OF THE INVENTION

The present invention is directed towards an improved wound golf ball and a method of making the same. The wound golf ball comprises a center covered with a wound layer, which in turn is surrounded by a cover layer. The center includes a non-wound shell with at least two layers, and the center is filled with a fluid. One layer is formed of a thermoset material and the other layer is formed of a thermoplastic material. The fluid disposed within the shell has a fluid volume of at least 0.5 cubic inches.

In one embodiment, the thermoset material is polybutadiene. In another embodiment, the thermoplastic material is hydrophobic. Hydrophobic materials such as polyetheramide block copolymer or a blend thereof or a blend of at least one hydrophilic, thermoplastic polymer and at least one hydrophobic polymer can be used.

In one embodiment, the thermoplastic material can be the innermost layer, and in another embodiment the thermoset material can be the innermost layer.

According to one aspect of the present invention, the shell can define a shell volume such that the fluid volume is less than about 60% of the shell volume. According to another aspect of the present invention, the wound layer has a wound layer volume, the shell has a shell layer volume, and a ratio of the wound layer volume to the shell layer volume is less than or equal to about 5.0.

According to another embodiment of the present invention, the golf ball includes the non-wound, two-layer, fluid-filled shell, the wound layer and the cover layer. However, the two-layer shell includes a first layer formed of a thermoset material and the second layer formed of a material with a water vapor permeation rate of less than about 250 (g·mil)/(100 $in^2$·day).

In other embodiments, the material of the second layer has a water vapor permeation rate less than 175 (g·mil)/(100 $in^2$·day).

The method of making the wound golf ball comprises the steps of forming a first layer for a shell using a thermoplastic material and injecting at least 0.5 cubic inches of fluid into the shell to form a fluid-filled envelope. Molding two, second layer hemispheres for the shell using a rubber material so that the fluid-filled envelope is surrounded with the second layer hemispheres. Curing the second layer hemispheres to form a center, surrounding the center with a wound layer to form a wound core, and forming a cover around the wound core.

The invention thus provides a novel wound ball and method of making the wound ball that offers good playing characteristics.

DETAILED DESCRIPTION OF THE PREFERRED EMBODIMENTS

Figure 1:
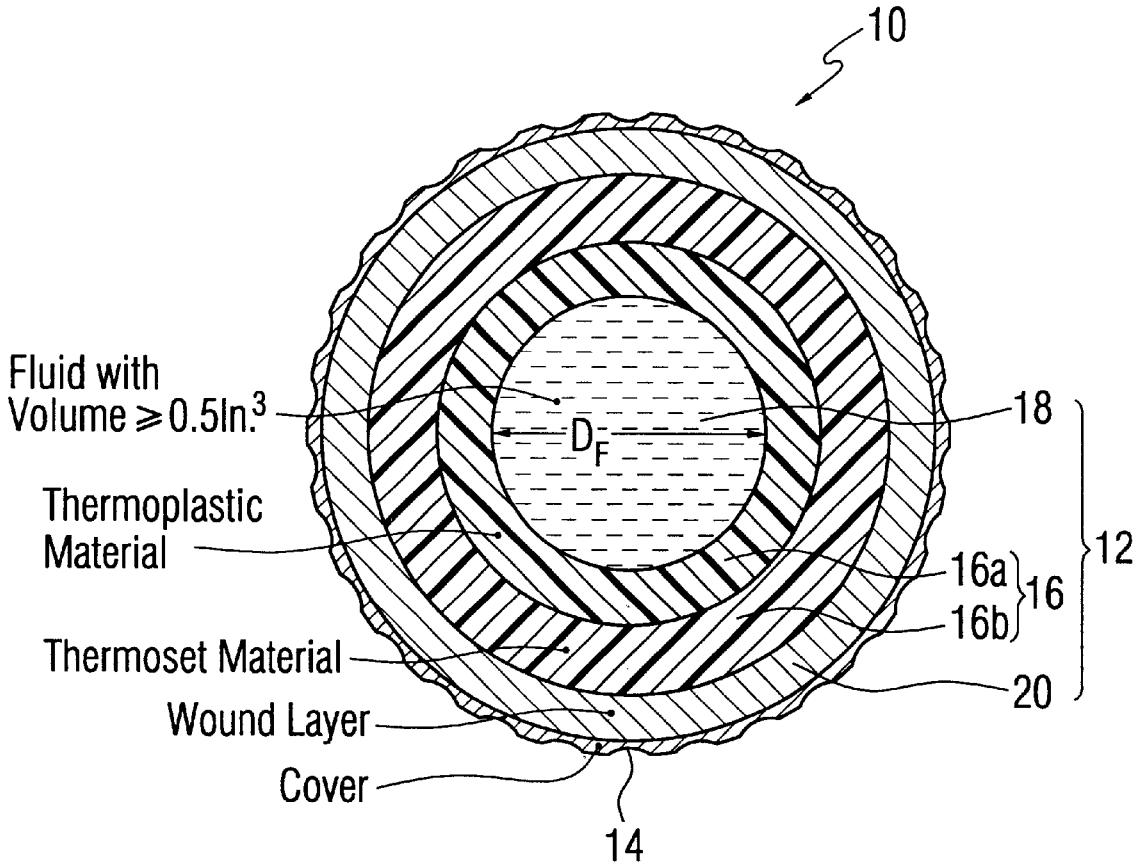
FIG. 1 is a cross-sectional view of a first embodiment of a golf ball according to the present invention.

Referring to FIG. 1 a golf ball 10 of the present invention is illustrated that includes a wound core 12 surrounded by a cover 14. The wound core 12 includes a shell or envelope 16 that contains a fluid 18. The two-layer shell 16 and the fluid 18 form a center of the golf ball. The shell 16 includes a first or inner layer 16*a* and a second or outer layer 16*b*, as discussed below. A wound layer 20 of thread is wrapped about the center so that the wound layer 20 is between the shell 16 and the cover 14. The center with the wound layer thereon forms the wound core 12.

It is recommended that at least one layer of the shell 16 is formed of a first, thermoplastic material and the other layer is formed of a second, thermoset material. It is preferred that the first layer 16*a* is formed of the first, thermoplastic material, and the second layer 16*b* is formed of the second, thermoset material. Thus, the thermoplastic material layer is the innermost layer adjacent the fluid 18 and the thermoset material layer is the outermost layer adjacent the wound layer 20.

Figure 2:
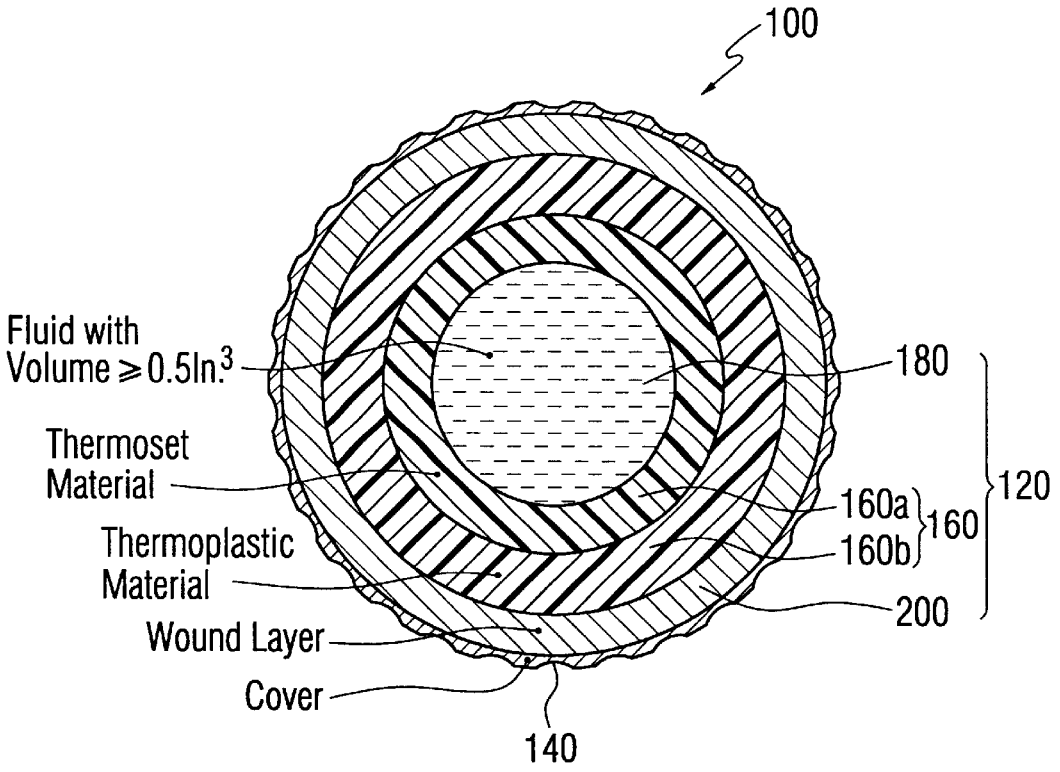
FIG. 2 is a cross-sectional view of a second embodiment of a golf ball according to the present invention.

Referring to FIG. 2 another embodiment of a golf ball 100 of the present invention is illustrated that includes a wound core 120 surrounded by a cover 140. The wound core 120 includes a two-layer shell or envelope 160 that contains a fluid 180. The molded shell 160 and the fluid 180 form the center of the golf ball. The shell 160 includes a first or inner layer 160*a* and a second or outer layer 160*b*. A wound layer 200 of thread is wrapped about the center so that the wound layer 200 is between the shell 160 and the cover 140. In this embodiment, the first layer 160*a* is a thermoset material, and the second layer 160*b* is a thermoplastic material.

For both embodiments, the shells 16 or 160 can be filled with a wide variety of fluid materials including gas, water or water solutions, gels, foams, hot-melts, other fluid materials and combinations thereof.

Suitable gases include air, nitrogen, argon, freon, and carbon dioxide. Preferably, the gas is a large-molecule gas and is inert. Examples of suitable liquids include water, glycol, glycerine, or solutions such as salt and corn syrup in water, corn syrup, salt in water, glycol and water, or oils. The liquid can further include pastes, colloidal suspensions, such as clay, barytes, carbon black in water or other liquid, or salt in water/glycol mixtures. Examples of suitable gels include water gelatin gels, hydrogens, water/methyl cellulose gels and gels comprised of copolymer rubber based materials such a styrene-butadiene-styrene rubber and paraffinic and/or naphthionic oil. Examples of suitable melts include waxes and hot melts. Hot-melts are materials which at or about normal room temperatures are solid but at elevated temperatures become liquid.

The fluid can also be a reactive liquid system which combines to form a solid or internal pressure within the shell. Examples of suitable reactive liquids that form solids are silicate gels, agar gels, peroxide cured polyester resins, two part epoxy resin systems and peroxide cured liquid polybutadiene rubber compositions. It is understood by one skilled in the art that other reactive liquid systems can likewise be utilized depending on the physical properties of the envelope and the physical properties desired in the resulting finished golf balls.

The fluid in the center can be varied to modify the performance parameters of the ball such as the moment of inertia Preferably, the fluid 18 or 180 in the center is comprised of a material that has a high specific gravity for high spin rate golf balls and a material that has a low specific gravity for a low spin rate golf ball. Preferably, the specific gravity of the fluid is below or equal to about 1.2 for low specific gravity centers and above about 1.2 for high specific gravity centers. More preferably, the specific gravity is approximately 1.15–1.2 for low specific gravity centers and approximately 1.3–1.55 for high specific gravity centers.

Still further, the fluid is preferably comprised of a material with a low viscosity for a golf ball having a high spin rate and a material having a high viscosity for a golf ball having a low spin rate. Preferably, the viscosity of the fluid center is less than about 100 centipoise cP for low viscosity centers and greater than or equal to about 100 cP for high viscosity centers. More preferably, the viscosity of the fluid center is less than or equal to about 10 cP for low viscosity centers and is between about 100 and about 1500 cP for high viscosity centers. Most preferably, the fluid center viscosity is approximately 500 cP for high viscosity centers.

As used herein, the term thermoplastic means either 1) a linear polymer or straight-chain macromolecules, or 2) branch-chained macromolecules, that soften when exposed to heat and returns to its original condition when cooled to room temperature. The polymer can be heated, re-formed and cooled repeatedly, as long as it is not heated above its decomposition point. As used herein, the term polymer means any type of polymer including random polymers, block polymers, graft polymers, etc.

A large number of thermoplastic polymeric materials are contemplated as being useful for the thermoplastic layer. The thermoplastic materials may be employed alone or in blends. Suitable thermoplastic materials include but are not limited to rubber modified polyolefins, metallocenes, polyether-ester block copolymers, polyether-amide block copolymers, thermoplastic based urethanes, copolymers of ethylene with butene and maleic anhydride, hydrogenated maleic anhydride, polyester polycaprolactone, polyester polyadipate, polytetramethylene glycol ether, thermoplastic elastomer, polypropylene, vinyl, chlorinated polyether, polybutylene terephalate, polymethylpentene, silicone, polyvinyl chloride, polycarbonate, polyurethane, polyamide, polybutylene, polyethylene and blends thereof The thermoplastic material can also be a thermoplastic resin such as polyethylene/saran ionomer, unmodified polyolefins, and ionomers.

Preferred rubber modified polyolefins are commercially available under the tradenames Vistaflex (Advanced Elastomer Systems), Kraton (Shell), Hifax (Montell), X1019-28 M. A. Hanna), Sarlink (DSM), and Santoprene (Advanced Elastomer Systems). Preferred metallocenes are available from Dow Corporation under the tradenames Engage and Affinity. Preferred polyether-amide block copolymers are available under the tradename Pebax (EIG Auto-Chem). In one embodiment, the hardness grade of the Pebax can be increased to decrease water vapor permeability thus, resulting in a hydrophobic thermoplastic layer. When the thermoplastic layer is the innermost layer, it may be hydrophobic, as defined below. Preferred polyether-ester block copolymers are commercially available from DuPont under the tradename Hytrel.

The thermoplastic material can further include a blend of at least one hydrophilic, thermoplastic polymer and at least one hydrophobic polymer forming a hydrophobic layer. Preferably, the hydrophobic polymer is compatible with the hydrophilic thermoplastic polymer. They may be formed using metallocene catalysts and they may be modified after polymerization using materials and methods known in the art, which include grafting of functional moieties onto the polymer.

As used herein, the term "glycidyl polymer" is defined as any homopolymer, copolymer, terpolymer, or mixture thereof, having at least one glycidyl group in at least one of the monomer repeat units in the polymer.

As used herein, the term "copolymer" refers to a polymer which is formed from two or more monomers, wherein said monomers are not identical.

As used herein, the term "terpolymer" refers to a polymer which is formed from three monomers, wherein said monomers are not identical.

The term "about," as used herein in connection with one or more numbers or numerical ranges, should be understood to refer to all such numbers, including all numbers in a range.

As used herein, the term "compatible" or a "compatibilized polymer blend" refers to a blend comprising at least one polymer component that has been chemically modified or synthesized in such a manner that it may then be mixed with other, chemically distinct polymeric materials, to form blends that are homogeneous on at least a macroscopic scale.

The terms "hydrophilic" and "hydrophobic," as used herein, are functionally defined. That is, for the purposes of this invention, a hydrophilic polymer is one that results in excessive water permeation rate, and the classification of a material as hydrophilic or hydrophobic in this context is, therefore, established empirically. A material with a water vapor permeation rate of greater than 250 (g·mil)/(100 $in^2$·day) is hydrophilic and a material with a water vapor permeation rate of less than 250 (g·mil)/100 $in^2$·day) is hydrophobic[1].

[1]The water vapor penneation rate was tested according to ASTM specification F-1249 using a sample 20 mils thick at 37.8° C. and 100% relative humidity.

It is recommended that, if the innermost layer is thermoplastic, then it is hydrophobic so that it exhibits a water vapor permeation rate of less than about 250 (g·mil)/(100 $in^2$·day). More preferably, the water vapor permeation rate is less than about 250 (g·)/(100 $in^2$·).

In compositions that comprise a blend of at least one hydrophilic, thermoplastic polymer and at least one hydrophobic polymer, the hydrophilic thermoplastic polymer can be a polyether-amide block copolymer, and the hydrophobic polymer can be a maleic anhydride grafted metallocene-catalyzed copolymer of ethylene and octene, ethylene and hexene, or ethylene and butene, or a copolymer of ethylene-n-alkylacrylate-glycidyl acrylate or ethylene-n-alkylacrylate-glycidyl methacrylate, or a blend of these metallocene-catalyzed copolymers. However, the present invention is not limited to these blends.

In a more specific embodiment, the hydrophilic thermoplastic polymer is a homopolymer, copolymer, terpolymer, block copolymer or some mixture of these. Similarly, the hydrophobic, thermoplastic polymer may be selected from among a homopolymer, copolymer, terpolymer, block copolymer or a mixture thereof.

In a further embodiment, the hydrophilic thermoplastic polymer is selected from the group consisting of polyether-ester block copolymers, polyester-ester block copolymers, polyether-amide block copolymers, polyester-amide block copolymers, thermoplastic urethanes, and blends thereof. Similarly, the hydrophobic polymer may be selected from the group consisting of ethylene-glycidyl acrylate copolymers, ethylene-glycidyl methacrylate copolymers, maleic anhydride grafted metallocene-catalyzed copolymers of ethylene and octene, maleic anhydride grafted metallocene-catalyzed copolymers of ethylene and hexene, maleic anhydride grafted metallocene-catalyzed copolymers of ethylene and butene, ethylene-n-butyl-acrylate-glycidyl acrylate terpolymers, ethylene-n-butyl-acrylate-glycidyl methacrylate terpolymers, ethylene-methyl acrylate-glycidyl acrylate terpolymers, ethylene-methyl acrylate-glycidyl methacrylate terpolymers, ethylene-n-butyl acrylate-methacrylic acid based ionomers, ethylene-n-butyl acrylate-acrylic acid based ionomers, and mixtures thereof.

U.S. patent application Ser. No. 09/453,697 filed on Dec. 3, 1999, pending and entitled "IMPROVED LIQUID CENTER FOR GOLF BALLS" discloses these and other blends of materials for the thermoplastic layer, formation of the layer, and balls incorporating the layer, and is expressly incorporated by reference herein in its entirety.

The thermoplastic material may also be comprised of a suitable filler material in order to adjust the properties of the finished center shell. For example, the specific gravity or density of the center shell may be adjusted by the addition of a suitable material, such as barium sulfate, zinc oxide, calcium carbonate, titanium dioxide, carbon black, kaolin, tungsten, tin oxide, magnesium aluminum silicate, silica, iron oxide, glass spheres, wollastonite, and other powdered metals. The filler material may be present in any amount that will adjust the specific gravity of the center shell. Such filler material may range from about 5 percent by weight to about 70 percent by weight. More preferably, the filler material is present in an amount less than about 45 weight percent.

Additionally, the thermoplastic material may also be comprised of a suitable plasticizer or other material in order to improve the processability and physical properties such as the flow properties of the thermoplastic materials. Plasticizers conventionally known in the art are contemplated as being suitable for use in the present invention. It is desirable that the thermoplastic material have a melt index[2] of about 1 gm/min. to about 52 gm/min. Preferably, the thermoplastic center core shell has a melt index of about 1.5 gm/min. to about 15 gm/min. The plasticizer may be present in any amount that will adjust the flow properties of the thermoplastic material.

[2] The melt index tests were carried out according to ASTM specification D-1238.

The thickness of the thermoplastic layer typically correlates, but is not necessarily limited to the manner in which the layer is produced. For example, the layers produced by a blow molding type of process generally are thinner than those produced by other molding processes such as by injection molding. The preferred thickness for the thermoplastic layer will likely vary depending upon the performance requirements desired.

Additionally, the method of manufacture will affect other physical characteristics of fluid-filled golf ball centers of the present invention. For example, in one embodiment of the present invention, the thermoplastic layer has a uniform thickness throughout. Such uniform thickness will result from the use of an injection molding method. This uniform thickness provides a beneficial contribution to a variety of in-flight characteristics of golf balls made with such cores including improved distance, accuracy and spin rate. However, the present invention is not limited to this method for forming so other molding methods for golf ball cores can be used.

In another embodiment of the present invention, the fluid-filled center can comprise a seamless spherical thermoplastic layer. Such seamless layers can be formed by one of the blow molding processes. The various blow molding processes that can be used are for example, extrusion blow molding, co-extrusion blow molding, and injection blow molding. The above described methods for forming the thermoplastic layer are disclosed in U.S. Pat. No. 5,836,831, entitled "Golf Ball" which is expressly incorporated by reference herein in its entirety.

Once the first layer shell is formed into a hollow sphere, it can be filled with the fluid by any number of methods. In one such method, the spheres are filled with a fluid using the conventional method, wherein the sphere is punctured with a hypodermic needle, injected with a fluid and the resulting hole is plugged with a thermally curable adhesive, a UV curable adhesive, a solvent or water based paint, a hot melt adhesive or a polymeric material. In a recommended method, the fluid is introduced via a coaxial needle.

If the innermost center layer is formed of hemispherical shells, in another method, the shells are filled with a fluid by joining the hemispheres together while the hemispheres are submerged in a bath of such fluid. In still another method, the sphere is filled by introducing the fluid through an inlet means which was integrally formed in a hemisphere or in the seamless centers during the molding thereof. The methods of filling the centers are further described in U.S. Pat. No. 5,836,831.

Now, the thermoset layer will be discussed. The term "thermoset" generally describes a polymeric material which solidifies or "sets" irreversibly when heated or exposed to radiation or a chemical reaction. Thermosetting polymers consist of linear chains having numerous functional groups or double bonds distributed along the chains, which are capable of forming crosslinks on further polymerization reactions. This may occur upon exposure to heat or other radiation or by adding special catalysts, resulting in a three-dimensional network that makes the polymer infusible and insoluble. These materials decompose at high temperatures instead of melting.

Recommended examples of thermoset or rubber materials are natural rubber, butadiene rubber, isoprene rubber, polyisoprene, thermoset polyurethane, styrene butadine, polybutadiene and combinations thereof. Polybutadiene is the preferred thermoset material. The present invention is not limited to the thermoset materials disclosed above. These thermoset materials can have filler therein as known by those of ordinary skill in the art.

The layer formed of the thermoset material can be formed using a number of conventional techniques. One method of forming the thermoset layer, if the thermoset layer is the outermost shell layer (as in FIG. 1) is as follows. Pieces of uncured rubber are manually wrapped around the first thermoplastic layer to a uniform thickness. Then, those pieces of uncured rubber are cured to form a sphere around the first layer. The pieces can be two half-shells which are preformed and subsequently joined around the fluid-filled sphere. The thus surrounded sphere is placed into a mold and subjected to a temperature and pressure such that the thermoset cures and forms a homogeneous, solid walled second layer around the fluid-filled sphere. The mold used to cure the thermoset is of sufficient size to hold the fully wrapped sphere.

Because the wrapped envelope is subjected to heat and pressure to cure the thermoset, it has been found that the fluid used to fill the center must have a sufficiently high boiling point to withstand boiling during the curing process of the wrap. Preferably, the fluid should have a boiling point of about 20°–30° C. above the cure temperature of the material used to wrap the center.

Figure 4:
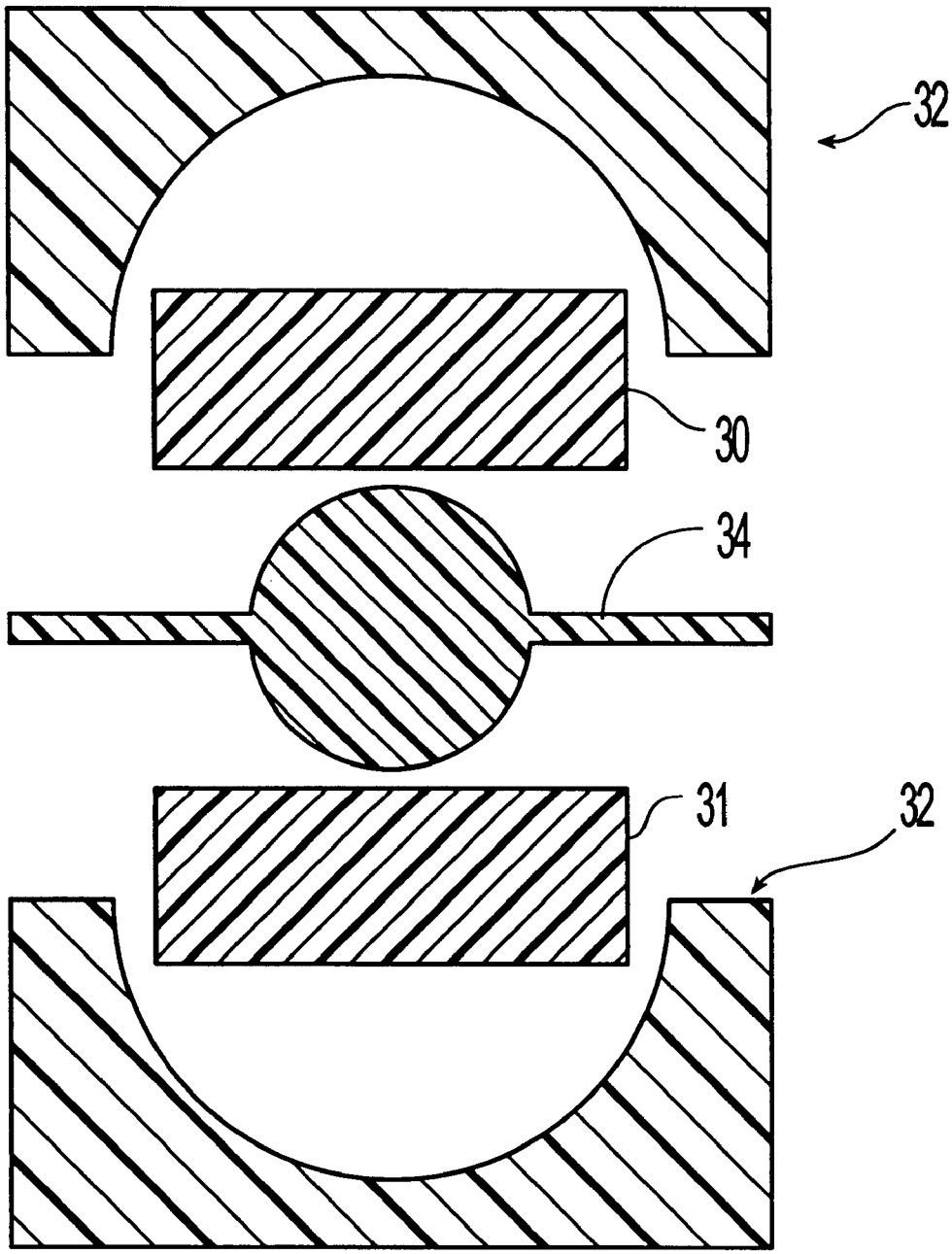
FIG. 4 is a cross-sectional view of a mold during forming a second rubber layer according to the present invention.
Figure 5:
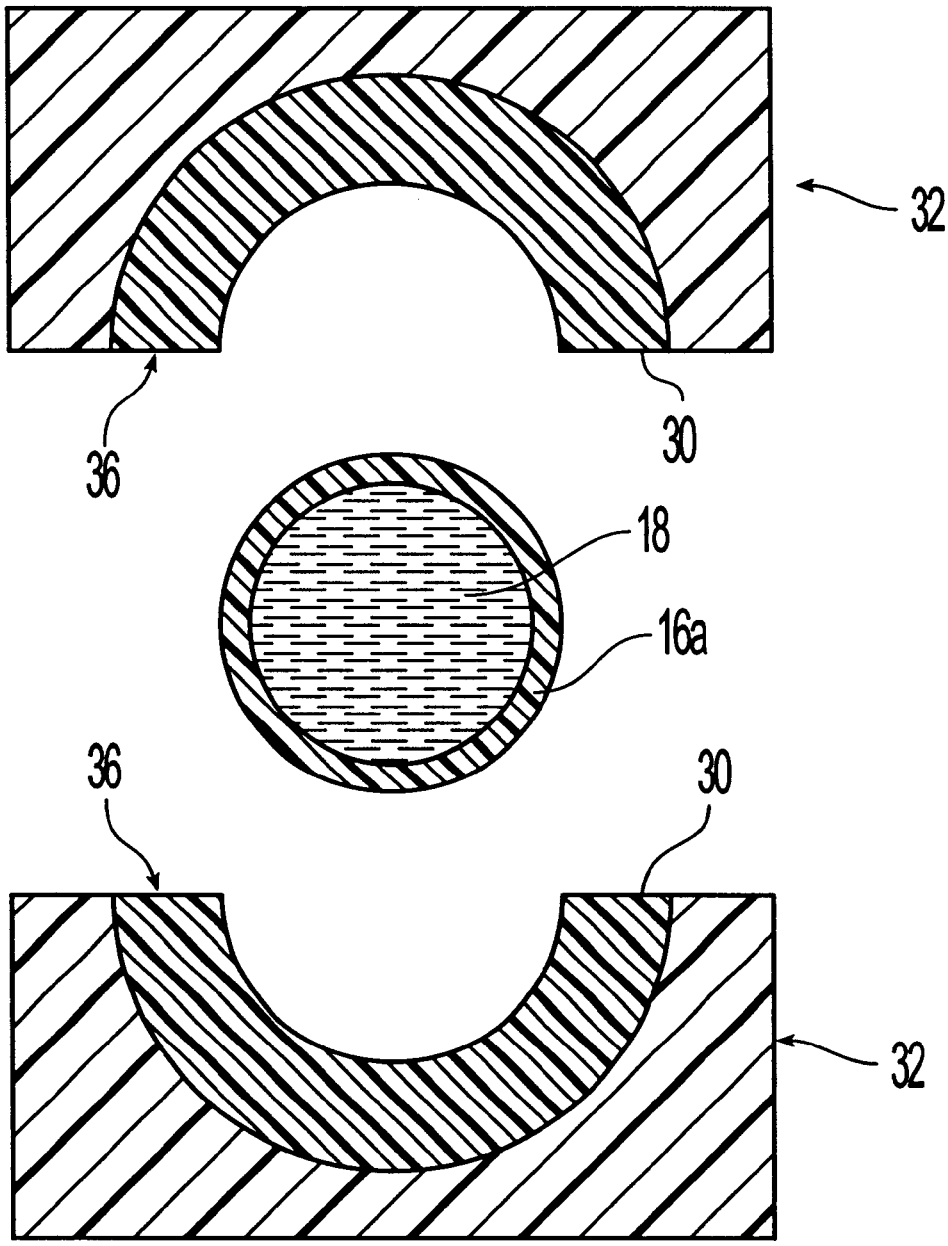
FIG. 5 is a cross-sectional view of the mold of FIG. 4 forming a golf ball center according to the present invention.

Another method of forming the thermoset layer is disclosed in U.S. Pat. No. 5,683,312 entitled "Fluid or Liquid Filled Non-Wound Golf Ball" which is expressly incorporated by reference herein in its entirety. Turning to FIGS. 1, 4 and 5, the golf ball 10 of the present invention can be formed by initially forming the first, thermoplastic layer 16*a* to create a hollow sphere and filling the sphere with fluid, as discussed above. Then the second layer 16*b* is formed by pre-forming top and bottom cups 30 and 31 of polybutadiene in a compression mold 32 with an inner fixture 34 as shown in FIG. 4. The mold 32 is then opened and the inner fixture 34 is removed, leaving a preform 36 in the top and bottom cups 30 and 31 of the second layer. The fluid-filled sphere including the first layer 16*a* is then inserted into the bottom cup 31 and the mold 32 is closed and run through a normal temperature and pressure cycle to crosslink the second layer 16*b* to form the two-layer center. The wound layer 20 is then formed on the center to form the wound core 12.

The cover 14 is of conventional construction such as balata, gutta percha, an ionomer or a blend of ionomers, Surlyn®, polyurethane, polyurea-based composition, epoxy-urethane-based compositions mettallocene catalysed polyoletins, cast elastomers, or a combination of the foregoing. The cover 14 is formed on the wound core 12 using techniques as know by those of ordinary skill in the art.

Referring to FIG. 2, one method of forming the inner layer, if the inner layer 160*a* is a thermoset material is as follows. Two sheets of the thermoset material, such as rubber sheets, and two mold plates can be used. Each mold plate has a plurality of half molds therein and a vacuum tube connected to the apex of each half mold. The vacuum causes the rubber sheet to take on the half mold shape. Water is sprayed across the bottom mold and the two mold plates are joined. The respective half molds also join to form a rubber sphere preform. This rubber sphere preform is subsequently subjected to additional heat to expand the envelope to a fully inflated hollow sphere. The envelope is then filled with the fluid in a conventional manner, usually by a hypodermic needle, and, finally, the hole left by the hypodermic needle is sealed. The second, thermoplastic layer 106*b* is then formed around the fluid-filled sphere by methods such as injection molding.

The center or shell layers preferably have a hardness of about 20 Shore A to 80 Shore D. More preferably, the center layers of the present invention have a Shore hardness about 50 to 70 Shore D. In one embodiment, the Shore D hardness of the first layer is different from the Shore D hardness of the second layer by at least 5. In another embodiment, the Shore D hardness of the inner layer is less than the Shore D hardness of the outer layer. In yet another embodiment, the Shore D hardness of the inner layer is less than the Shore D hardness of the outer layer by at least 5 points. It is also recommended that the cover layer have a Shore D hardness of less than 72 points.

Likewise, the center or shell layers of the present invention can have a flexural modulus of less than or equal to about 3000 psi. More preferably, the center or shell layers of the present invention can have a flexural modulus of less than or equal to 20 about 500 psi.

Further, the center or shell layers of the present invention preferably have a specific gravity of about 0.70 to about 3.0. More preferably the specific gravity of the center layers is about 0.80 to about 2.2.

Compression is determined using a commercial ATTI compression tester. These measurements are performed in a conventional manner well-known to those of skill in the art of golf ball manufacturing. It is preferred that the two-layer center has a center compression of about 50 to about 80, and the golf ball have a compression of about 75 to 30 about 100. More preferably, the center compression is about 70 to about 75 and the golf ball compression is about 85 to about 95.

EXAMPLES

These and other aspects of the present invention may be more fully understood with reference to the following non-limiting examples, which are merely illustrative of the embodiments of the present invention golf ball, and are not to be construed as limiting the invention, the scope of which is defined by the appended claims Example 1

It is recommended that the volume of the fluid VF satisfies the following relationship:

$$V_F \geqq 0.5 \text{ inches}^3 \quad \text{(Eq. 1)}$$

Figure 3:
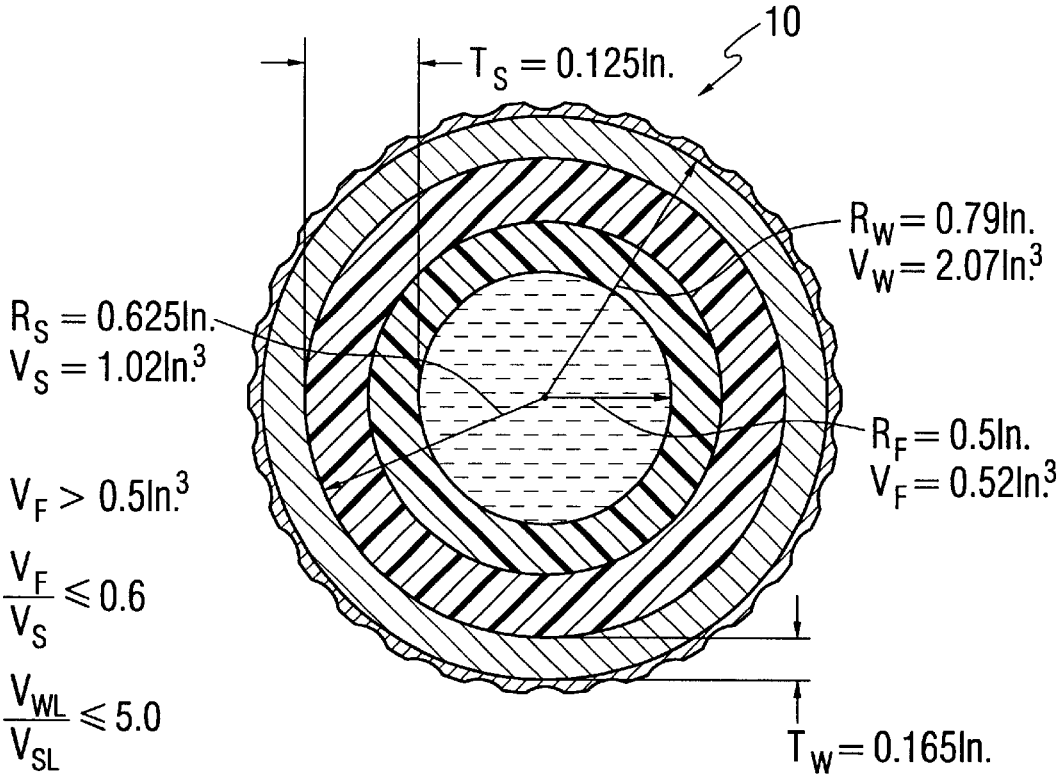
FIG. 3 is a cross-sectional view of the golf balls shown in FIGS. 1 and 2 illustrating relationships between various components of the balls.

Referring to FIGS. 1 and 3, one embodiment which achieves this requirement is shown, which has a fluid diameter $D_F$ or center inner diameter of 1.00 inches or greater. This results in a fluid radius $R_F$ of 0.5 inches.

The fluid volume $V_F$ is determined according to the following formula:

$$V_F = \frac{4}{3}\pi R_F^3$$

when $R_F$=0.5 inches, $V_F$=0.51 inches$^3$ which is greater than 0.5 inches$^3$.

The shell volume $V_S$ is determined using the radius of the shell $R_S$ as shown in FIG. 3. The radius of the shell is the fluid radius $R_F$ combined with the shell wall thickness $T_S$. In the example shown in FIG. 3, the shell wall thickness $T_S$ is 0.125 inches;

therefore the shell radius $R_S$ is 0.625 inches. The shell volume $V_S$ is determined according to the following formula:

$$V_S = \frac{4}{3}\pi R_S^3$$

when $R_S$=0.625 inches, $V_S$=1.02 inches$^3$. It is recommended that the fluid volume $V_F$ is less than about 60% of the shell volume $V_S$. This relationship is represented by the equation below.

$$\frac{V_F}{V_s} \leq \text{about } 0.6 \quad \text{(Eq. 2)}$$

When fluid volume $V_F$=0.52 inches$^3$ and the shell volume $V_S$=1.02 inches$^3$ $$\frac{V_F}{V_s} = 0.51 \text{ which is less than } 0.6.$$

The wound volume $V_W$ is determined using the radius of the wound core $R_W$ as shown in FIG. 3. The radius of the wound core $R_W$ is the fluid radius $R_F$ plus the shell wall thickness $T_S$, plus the thickness of the wound layer $T_W$. In the example shown in FIG. 3, the wound layer thickness $T_W$ is 0.165 inches; therefore the wound core radius $R_W$ is 0.79 inches. The wound volume $V_W$ is determined according to the following formula:

$$V_W = \frac{4}{3}\pi R_W^3$$

when $R_W$=0.79 inches, $V_W$=2.07 inches$^3$.

The wound layer volume $V_{WL}=V_W-V_S$=2.07 inches$^3$−1.02 inches$^3$=1.05 inches$^3$.

The shell layer volume $V_{SL}=V_S-V_F$=1.02 inches$^3$−0.52 inches$^3$=0.50 inches$^3$.

It is recommended that the ratio of the wound layer volume $V_{WL}$ to the shell layer volume has the relationship below:

$$\frac{V_{WL}}{V_{SL}} \leq \text{about } 5.0 \quad \text{(Eq. 3)}$$

When the wound layer volume $V_{WL}$=1.05 inches$^3$ and the shell layer volume $V_{SL}$=0.050 inches$^3$:

$$\frac{V_{WL}}{V_{SL}} = 2.10, \text{ which is less than } 5.0$$

Example 2

In Example 2, the golf ball has different dimensions as discussed below:

$R_F$=0.50 inches so $V_F$=0.52 inches$^3$, $T_S$=0.10 inches so $R_S$=0.60 inches, and $V_S$=0.90 inches$^3$, $T_W$=0.19 inches so $R_W$=0.79 inches, and $V_W$=2.07 inches$^3$.

The wound layer volume $V_{WL}=V_W-V_S$=2.07 inches$^3$= 0.90 inches$^3$=1.17 inches.

The shell layer volume $V_{SL}=V_S-V_F$=0.90 inches$^3$−0.52 inches$^3$=0.38 inches$^3$.

As a result, $V_F$=0.52, which is greater than 0.5 inches$^3$;

$$\frac{V_F}{V_S} = 0.58 \text{ inches}^3, \text{ which is less than } 0.6; \text{ and}$$

$$\frac{V_{WL}}{V_{SL}} = 3.08 \text{ inches}^3, \text{ which is less than } 5.0.$$

Thus, in Example 2, the relationships in Equations 1–3 are satisfied.

Example 3

In Example 3, the golf ball has different dimensions as discussed below:

$R_F$=0.5 inches so $V_F$=0.52 inches$^3$, $T_S$=0.16 inches so $R_S$=0.66 inches, and $V_S$=1.20 inches$^3$, $T_W$=0.13 inches so $R_W$=0.79 inches, and $V_W$=2.07 inches$^3$.

The wound layer volume $V_{WL}=V_W-V_S$=2.07 inches$^3$−1.20 inches$^3$=0.87 inches$^3$.

The shell layer volume $V_{SL}=V_S-V_F$=1.20 inches$^3$−0.52 inches$^3$=0.68 inches$^3$.

As a result, $V_F$=0.52, which is greater than 0.5 inches$^3$;

$$\frac{V_F}{V_S} = 0.43 \text{ inches}^3, \text{ which is less than } 0.6; \text{ and}$$

$$\frac{V_{WL}}{V_{SL}} = 1.28 \text{ inches}^3, \text{ which is less than } 5.0.$$

Thus, in Example 3, the relationships in Equations 1–3 are satisfied.

For all examples it is recommended that the cover layer thickness is 0.04 inches or greater.

It will be understood that the claims are intended to cover all changes and modifications of the preferred embodiments of the invention herein chosen for the purpose of illustration which do not constitute a departure from the spirit and scope of the invention.

I claim:

1. A wound golf ball comprising:

a. a center including i. a non-wound shell having at least two layers wherein the first layer is formed of a first material and the second layer is formed of a second material, and the first material is a thermoset material and the second material is a thermoplastic material; and ii. a fluid being disposed within the shell, the fluid having a fluid volume of at least 0.5 cubic inches;

b. a wound layer disposed about the shell to form a wound core; and c. a cover surrounding the wound core.

2. The wound golf ball of claim 1, wherein the first material is selected from the group consisting of natural rubber, butadiene rubber, isoprene rubber, polyisoprene, thermoset polyurethane, styrene butadine, polybutadiene or combinations thereof.

3. The wound golf ball of claim 2, wherein the second material is selected from the group consisting of rubber modified polyolefins, metallocenes, polyether-ester block copolymers, polyether-amide block copolymers, thermoplastic based urethanes, copolymers of ethylene with butene and maleic anhydride, hydrogenated maleic anhydride, polyester polycaprolactone, polyester polyadipate, polytetramethylene glycol ether, thermoplastic elastomer, polypropylene, vinyl, chlorinated polyether, polybutylene terephalate, polymethylpentene, silicone, polyvinyl chloride, polycarbonate, polyamide, polybutylene, polyethylene, thermoplastic resin, a hydrophobic thermoplastic material, or blends thereof.

4. The wound golf ball of claim 1 wherein the first material is polybutadiene.

5. The wound golf ball of claim 4, wherein the second material is a hydrophobic thermoplastic material.

6. The wound golf ball of claim 1, wherein the second material is a blend of at least one hydrophilic, thermoplastic polymer and at least one hydrophobic polymer.

7. The wound golf ball of claim 1, wherein the second material is a polyethylene/saran ionomer, a polyether-amide block copolymer or blend thereof.

8. The wound golf ball of claim 1, wherein the first material has a first Shore D hardness and the second material has a second Shore D hardness, and the difference between the first Shore D hardness and the second Shore D hardness is at least 5 points.

9. The wound golf ball of claim 1, wherein the first material is adjacent the fluid and the second material is adjacent the wound layer.

10. The wound golf ball of claim 1, wherein the first material is adjacent the wound layer and the second material is adjacent the fluid.

11. The wound golf ball of claim 10, wherein the second material has a melt temperature that is greater than a cure temperature of the first material.

12. The wound golf ball of claim 1, wherein the fluid has a viscosity greater than about 100 cP.

13. The wound golf ball of claim 1, wherein the second material has a water vapor permeation rate less than 250 (g·mil)/(100 in$^2$·day).

14. The wound golf ball of claim 1, wherein the shell further including a shell volume and the fluid volume is less than 60% of the shell volume.

15. The wound golf ball of claim 1, wherein the wound layer further including a wound layer volume, the shell further including a shell layer volume, and a ratio of the wound layer volume to the shell layer volume is less than or equal to about 5.0.

16. The wound golf ball of claim 1, further including a ball compression of about 75 to about 100, and the center having a center compression of about 50 to about 80.

17. A wound golf ball comprising:

a. a center including i. a non-wound shell having at least two layers wherein the first layer is formed of a first material and the second layer is formed of a second material, and the first material is a thermoset material and the second material has a water vapor permeation rate of less than about 250 (g·mil)/(100 in$^2$·day); and ii. a fluid being disposed within the shell;

b. a wound layer disposed about the shell to form a wound core; and c. a cover surrounding the wound core.

18. The wound golf ball of claim 17, wherein the second material has a water vapor permeation rate less than about 175 (g·mil)/(100 in$^2$·day).

19. The wound golf ball of claim 17, wherein the first material is selected from the group consisting of natural rubber, butadiene rubber, isoprene rubber, polyisoprene, thermoset polyurethane, styrene butadine, polybutadiene or combinations thereof.

20. The wound golf ball of claim 17, wherein the second material is a thermoplastic.

21. The wound golf ball of claim 20, wherein the second material is selected from the group consisting of rubber modified polyolefins, metallocenes, polyether-ester block copolymers, polyether-amide block copolymers, thermoplastic based urethanes, copolymers of ethylene with butene and maleic anhydride, hydrogenated maleic anhydride, polyester polycaprolactone, polyester polyadipate, polytetramethylene glycol ether, thermoplastic elastomer, polypropylene, vinyl, chlorinated polyether, polybutylene terephalate, polymethylpentene, silicone, polyvinyl chloride, polycarbonate, polyamide, polybutylene, polyethylene, thermoplastic resin, a hydrophobic there blends thereof.

22. The wound golf ball of claim 17, wherein the second material is a blend of at least one hydrophilic, thermoplastic polymer and at least one hydrophobic, thermoplastic polymer.

23. A method of making a wound golf ball comprising the steps of:

a. forming a first layer for a shell using a thermoplastic material;

b. injecting at least 0.5 cubic inches of fluid into the shell to form a fluid-filled envelope;

c. molding two, second layer hemispheres for the shell using a rubber material;

d. surrounding the fluid-filled envelope with the second layer hemispheres and curing the second layer hemispheres to form a center;

e. surrounding the center with a wound layer to form a wound core; and f. forming a cover around the wound core.

* * * * *